US008142129B2

(12) United States Patent
Sielermann et al.

(10) Patent No.: US 8,142,129 B2
(45) Date of Patent: Mar. 27, 2012

(54) METHOD AND APPARATUS FOR FEEDING ITEMS OF LAUNDRY TO A LAUNDRY TREATMENT DEVICE, IN PARTICULAR A MANGLE

(75) Inventors: Jürgen Sielermann, Heubach (DE); Friedhelm Mehrhoff, Hille (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 321 days.

(21) Appl. No.: 12/211,270

(22) Filed: Sep. 16, 2008

(65) Prior Publication Data

US 2009/0092464 A1 Apr. 9, 2009

(30) Foreign Application Priority Data

Oct. 5, 2007 (DE) ..... 10 2007 048 051
Apr. 30, 2008 (DE) ..... 10 2008 021 810

(51) Int. Cl.
*D06F 95/00* (2006.01)
*D06F 67/04* (2006.01)

(52) U.S. Cl. ..... 414/13; 38/143; 38/7; 198/465.4

(58) Field of Classification Search ..... 104/130.01; 198/352, 358, 367, 436, 465.3, 465.4, 466.1, 198/560, 678.1, 680–681, 684–685, 687.1, 198/803.2; 38/143, 7–8; 414/13
See application file for complete search history.

(56) References Cited

U.S. PATENT DOCUMENTS 4,114,538 A * 9/1978 Nicodemus et al. ..... 104/88.04
(Continued)

FOREIGN PATENT DOCUMENTS

DE 26 44 944 C2 11/1985
(Continued)

OTHER PUBLICATIONS

DE Search Report.

*Primary Examiner* — Gregory Adams
(74) *Attorney, Agent, or Firm* — Laurence P. Colton; Smith Risley Tempel Santos LLC

(57) ABSTRACT

Items of laundry have to be stretched out by a spreading device (14) before they are inserted into a mangle or any other laundry treatment device. To this end, the spreading device (14) has spreading clips (15) which can be moved away from one another. In the case of relatively large items of laundry, the spreading clips (15) have to cover a relatively large distance in order to spread out the item of laundry. This reduces the insertion rate. The invention provides for the items of laundry to be preliminarily spread out before being passed to the spreading clips (15), so that the spreading clips (15) receive the item of laundry in a state in which it is already virtually spread out. The spreading clips (15) only have to cover a small residual distance in order to spread out the item of laundry completely. As a result, the spreading device (14) can spread out the item of laundry very quickly. It is particularly advantageous to measure the width of the item of laundry and to then preliminarily spread out the item of laundry as far as possible as a function of the measured width.

26 Claims, 3 Drawing Sheets

U.S. PATENT DOCUMENTS

| | | | | |
|---|---|---|---|---|
| 5,349,768 | A * | 9/1994 | Ishihara et al. | 38/143 |
| 6,481,359 | B1 * | 11/2002 | Owens | 104/130.01 |
| 6,827,200 | B1 * | 12/2004 | Rhodes | 198/680 |
| 2007/0000757 | A1 * | 1/2007 | Tabler | 198/465.4 |

FOREIGN PATENT DOCUMENTS

| | | | |
|---|---|---|---|
| DE | 38 39 045 | A1 | 7/1989 |
| DE | 90 14 821 | U1 | 1/1991 |
| DE | 197 03 587 | A1 | 8/1998 |
| DE | 198 39 004 | A1 | 2/2000 |
| EP | 02 72 368 | A1 | 6/1988 |
| EP | 03 72 320 | A2 | 6/1990 |
| EP | 05 48 797 | B1 | 12/1992 |
| EP | 0 982 428 | A | 3/2000 |
| FR | 2 336 510 | A | 7/1977 |
| GB | 2 251 866 | A | 7/1992 |
| JP | 05 103900 | A | 4/1993 |

* cited by examiner

METHOD AND APPARATUS FOR FEEDING ITEMS OF LAUNDRY TO A LAUNDRY TREATMENT DEVICE, IN PARTICULAR A MANGLE

STATEMENT OF RELATED APPLICATIONS

This application is based on and claims the benefit under 35 USC 119 of German Patent Application No. 10 2007 048 051.4 having a filing date of 5 Oct. 2007 and German Patent Application No. 10 2008 021 810.3 having a filing date of 30 Apr. 2008, both of which are incorporated herein in their entireties by this reference.

BACKGROUND OF THE INVENTION

1. Technical Field

The invention relates to a method for feeding items of laundry to a laundry treatment device, in particular a mangle, with the respective item of laundry being transferred from a conveying device to spreading clips of a spreading device and the item of laundry being spread out by the spreading device for further transportation of a spread-out item of laundry from a feed conveyor to the laundry treatment device. The invention also relates to an apparatus for feeding items of laundry to a laundry treatment device, such as a mangle, having a feed conveyor, a spreading device, which is arranged upstream of the said feed conveyor, for spreading out the item of laundry by stretching a front edge of the said item of laundry, with the spreading device having at least two spreading clips for holding opposite corners of the front edge of the item of laundry, and having a conveying device, which has movable transporting clips, for transporting an item of laundry, which is held at the corners which bound the front edge, to the spreading clips of the spreading device.

2. Related Art

In industrial laundries, items of laundry are spread out by a so-called insertion machine and thus fed to or inserted into a downstream laundry machine, in particular a mangle. The insertion machine has a spreading device with at least two spreading clips, which can be moved transverse to the feed direction, and a feed conveyor. The spreading clips of the spreading device spread out the item of laundry by stretching a front edge of the said item of laundry. The stretched item of laundry is then passed from the spreading device directly to the feed conveyor or to an insertion strip which pulls the item of laundry onto the feed conveyor. From the feed conveyor, the spread-out item of laundry is transported in the insertion direction to the laundry treatment device and inserted into the said laundry treatment device.

The items of laundry are transported to the spreading clips by a loading device or a conveying device, with adjacent corners of the front edge of the item of laundry hanging in transporting clips on the conveying device. The respective item of laundry is transferred between the conveying device and the spreading device from the transporting clips to the spreading clips.

One disadvantage of the known manner of feeding items of laundry to a laundry treatment device, in particular a mangle, is the spreading out of the items of laundry by means of the spreading device. The adjacent corners of the front edge of the item of laundry are usually received by the closed spreading clips or passed to the said spreading clips close to one another. The spreading clips then have to be moved away from one another virtually over the entire length of the front edge, that is to say the entire width of the item of laundry, in order to spread out the item of laundry. This is time consuming.

BRIEF SUMMARY OF THE INVENTION

The invention is based on the object of providing a method and an apparatus for feeding items of laundry to a laundry treatment device, in particular a mangle, which ensure high feed rates.

A method for achieving this object is a method for feeding items of laundry to a laundry treatment device, such as a mangle, with the respective item of laundry being transferred from a conveying device to spreading clips of a spreading device and the item of laundry being spread out by the spreading device for further transportation of a spread-out item of laundry from a feed conveyor to the laundry treatment device, characterized in that at least some items of laundry are spread out at least for the most part by the conveying device and the spread-out items of laundry are passed to the spreading clips.

Since the item of laundry is already at least partially, preferably for the most part, spread out or spread in the region of the conveying device and the spread-out item of laundry is passed from the conveying device to the spreading clips or is received from the conveying device by means of the spreading clips, the item of laundry only needs to be finally spread by the spreading device. To this end, the spreading clips no longer need to be moved away from one another over the entire width of the item of laundry, but only over a remainder of the width. The time required to spread out each item of laundry is reduced as a result. Accordingly, the method according to the invention permits shorter cycle times when feeding items of laundry to a treatment device, in particular a mangle, because the method according to the invention provides for the items of laundry to be preliminarily spread out or else preliminarily spread, so that the items of laundry only have to be finally spread in the downstream spreading device.

According to a preferred development of the method, provision is made for the length of an edge of the item of laundry between two adjacent edges, specifically in particular the front edge which is to be spread out, to be measured in the region of the conveying device, specifically preferably before the item of laundry is preliminarily spread out by the conveying device. As a result, the size of the item of laundry, in particular the width between adjacent edges of the front edge of the item of laundry, is known before the item of laundry is preliminarily spread out by the conveying device and completely spread out by the spreading device. The known width of the item of laundry can be used for individual preliminary spreading-out purposes, in particular for defining the extent of preliminary spreading out, but also for moving the spreading clips away from one another in a specifically positioned manner in order to spread out the item of laundry completely. However, it is also feasible to determine the width of the respective item of laundry in another way, for example by it reading off from a data storage medium on the respective item of laundry, in particular a chip. The known width of the item of laundry can then also be used to preliminarily spread and/or finally spread the said item of laundry, without the width of the item of laundry having to be measured in the region of the conveying device.

Provision is also made for the adjacent corners of the front edge of each item of laundry, in particular transporting clips which hold these, to be channeled into different, parallel conveying sections of the conveying device. The different, parallel conveying sections are located at least upstream of the spreading device. In this case, these conveying sections are preferably arranged upstream of the spreading device in such a way that the corners of the respective item of laundry can be transferred from the conveying sections to the spreading clips of the spreading device.

The parallel conveying sections upstream of the spreading device are at a distance from one another which corresponds to the distance between the corners of the item of laundry which bound the front edge of the item of laundry after preliminary spreading. If the transporting clips which hold the adjacent corners of the respective item of laundry are then inserted into the parallel conveying sections, the front edge of the item of laundry is for the most part spread out, specifically preliminarily spread out or preliminarily stretched. The respective item of laundry is preliminarily spread virtually automatically when the respective item of laundry is transported from the conveying device to or along the conveying sections upstream of the spreading device.

According to a further advantageous refinement of the method, provision is made for the transporting clips which hold the respective item of laundry at opposite corner regions to be driven at least during spreading out, in particular preliminary spreading out or preliminary spreading. This ensures that the transporting clips move further during spreading out of the item of laundry, to be precise primarily uniformly, specifically synchronously. The force required during spreading out of the item of laundry by movement of the transporting clips which hold this item of laundry along different conveying sections or conveying section portions can thus be reliably applied, without the risk of the transporting clips coming to a halt or not moving further uniformly on the conveying sections during preliminary spreading out.

In a preferred refinement of the method, more than two parallel conveying sections are provided upstream of the spreading device. The distances between in each case two parallel conveying sections are different, so that the distance between the corners bounding the conveying edge of the respective item of laundry and therefore the extent of preliminary spreading of the front edge of the item of laundry can be varied by channeling the transporting clips which hold the corners of the item of laundry into in each case two selected parallel conveying sections. As a result, it is possible to preliminarily spread out or preliminarily stretch items of laundry of different widths as a function of their known or previously measured width as far as possible, so that the item of laundry only has to be slightly further spread out by the spreading clips of the spreading device.

An apparatus for achieving the object mentioned in the introduction is an apparatus for feeding items of laundry to a laundry treatment device, such as a mangle, having a feed conveyor, a spreading device, which is arranged upstream of the said feed conveyor, for spreading out the item of laundry by stretching a front edge of the said item of laundry, with the spreading device having at least two spreading clips for holding opposite corners of the front edge of the item of laundry, and having a conveying device, which has movable transporting clips, for transporting an item of laundry, which is held at the corners which bound the front edge, to the spreading clips of the spreading device, characterized in that the conveying device has at least two parallel conveying sections upstream of the spreading device, which conveying sections are at such a distance from one another that the transporting clips which are located in different conveying lines hold the opposite corners of the item of laundry by way of a preliminarily spread-out front edge.

According to the said apparatus, provision is made for the conveying device to have at least two parallel conveying sections upstream of the spreading device, which conveying sections are at such a distance from one another that the transporting clips which are located on different conveying sections hold the opposite corners of the item of laundry by way of a preliminarily spread-out front edge. The front edge of the item of laundry is therefore necessarily preliminarily spread out when the item of laundry is conveyed to the spreading device since the transporting clips which hold the corners of the item of laundry are transported along the conveying sections, which are at corresponding distances, upstream of the spreading device.

In a preferred refinement of the apparatus, the conveying device has more than two, preferably four, parallel conveying sections. The conveying sections are arranged upstream of the spreading device and symmetrically in relation to the center of the spreading device. In this case, the conveying sections are preferably distributed in pairs over different sides of the spreading device, that is to say to the left and to the right in relation to the center of the spreading device which corresponds to the track center of the downstream feed conveyor. The distances between in each case two conveying sections which are arranged at identical distances from the center of the spreading device on different sides of the said spreading device are preferably different. Two inner conveying sections on opposite sides of the center of the spreading device are situated closer together than two outer conveying sections. In this case, the distance between the conveying sections on the same side of each spreading device is less than the distance between the adjacent inner conveying sections on opposite sides of the spreading device. As a result, three different distances between the corners of the front edge can be realized with four conveying sections with items of laundry to be preliminarily spread out in each case. Large items of laundry which are supplied on a single track centrally by the feed conveyor to the laundry treatment device can therefore be preliminarily stretched to different extents depending on whether the items of laundry are items of laundry of the maximum width or narrower items of laundry which require only single-track insertion. Even smaller items of laundry which can be fed on two tracks from the feed conveyor to the laundry treatment device by each side of the feed conveyor forming a track are either not preliminarily spread out at all or only to the extent that they do not project beyond the respective side, that is to say a track half of the feed conveyor.

According to a further refinement of the apparatus, the conveying sections of the conveying device which are arranged upstream of the spreading device have upright section portions. The said section portions are preferably vertical section portions. The section portions are associated with the spreading clips in such a way that the corners of the item of laundry held on the transporting clips can be passed to the spreading clips from the transporting clips which are moved along the upright section portions, or the spreading clips can receive the corners of the item of laundry from the transporting clips. As a result, it is possible to pass the corners of the item of laundry from the conveying device to the spreading device in the manner of a flying change since the corners of the item of laundry are passed from the transporting clips to the spreading clips as the transporting clips which are moved upward or downward on the vertical section portions pass by the spreading clips.

According to a further proposal of the invention, the conveying device has at least one loading station. In the loading station, the respective item of laundry is manually hung in successive transporting clips of the conveying device by way of two adjacent corners of an edge, in particular the front edge. A plurality of loading stations can be provided so that several people can hang items of laundry in the transporting clips independently of one another.

Provision is also made for the conveying device to have an obliquely or vertically rising profile in the region of its loading station. As a result, the items of laundry can be hung in the transporting clips of the conveying device by the respective operator at an ergonomically expedient low level. On account of the rising profile of the conveying device in the region of each loading station, the items of laundry are then raised, so that the items of laundry on the conveying device are transported further as far as the spreading device of the insertion machine in a manner in which they hang down freely.

In a preferred refinement of the invention, the conveying device is of single-track design in the region of each loading station and preferably also adjoining conveying section portions. All transporting clips are transported further one behind the other along the single-track part of the conveying device. Multiple-track portions with conveying sections which are situated parallel next to one another and run in the insertion direction of the feed conveyor follow the single-track portion of the conveying device by means of branching-off, switch points or the like. The single-track section portion of the conveying device, in which portion the transporting clips run one behind the other, reorients the transporting clips in the multiple-track section portion with parallel conveying sections by means of switch points or other branching means. The transporting clips are reoriented in such a way that the two transporting clips which hold adjacent corners of the front edge of the item of laundry enter different section portions, preferably conveying sections, which are situated at a distance next to one another, as a result of which the item of laundry is reoriented by being moved into a position in which the front edge of the item of laundry runs transverse to the insertion direction. By virtue of the two transporting clips which hold an item of laundry being reoriented in different parallel conveying sections of the conveying device, the item of laundry is preliminarily spread out since the transporting clips are channeled into those conveying sections which are situated next to one another and are at a distance from one another which corresponds to the extent to which the respective item of laundry should be preliminarily spread out. By selecting corresponding conveying sections, the two transporting clips which hold an item of laundry are at a distance from one another which is somewhat smaller than the width of the front edge of the item of laundry, but the slack in the front edge of the item of laundry is already reduced for the most part, specifically is only relatively small. When there are more than two parallel conveying sections upstream of the spreading device, the spreading clips are conducted to those conveying sections in which the front edge of the item of laundry is preliminarily spread out to the greatest possible extent in accordance with the size, in particular the width, of the item of laundry. In the case of small items of laundry, the two transporting clips which hold these items of laundry are conducted into conveying sections on one or the other side next to the center of the spreading device, so that relatively small items of laundry can be inserted on multiple tracks by means of the insertion machine.

At least in the conveying sections or conveying section portions upstream of the spreading device, the two transporting clips which hold adjacent corners of the respective item of laundry are uniformly driven along different conveying sections, so that the item of laundry is transported on to the spreading device such that it is oriented transverse to the insertion direction. The transporting clips which hold opposite corner regions of in each case one item of laundry are primarily driven in the region of those conveying section portions on which the item of laundry is preliminarily spread out. This ensures reliable uniform stretching or preliminary spreading out of the item of laundry, in particular ensures uniform, synchronous forward movement of the transporting clips on the conveying section portions which effect preliminary spreading out. The transporting clips are preferably driven onto the conveying section portions by separate conveying lines which are driven so as to revolve, in particular brush belts which are driven so as to revolve. The conveying lines are arranged next to the rails on or in which the transporting clips run. An arrangement of this kind permits the respective conveying line to be placed on those rail portions next to the rails in which the respective item of laundry is preliminarily spread out, specifically spread to the greatest possible extent.

The choice of those conveying sections or section portions in which the two spreading clips which hold each item of laundry are transferred from the single-track section portion, by switch points or the like, to the multiple-track section portion, preferably the conveying section portions, is defined by the control system on the basis of the known width of the front edge of the item of laundry, preferably on the basis of the previously measured width of the front edge of the item of laundry, since the two transporting clips which hold the item of laundry are channeled into the intended or suitable conveying sections upstream of the spreading device in a specific manner.

According to a preferred development of the invention, provision is made for the conveying device to have at least one storage means for a supply of items of laundry which are hung on transporting clips. As a result, the insertion machine can be operated independently of the performance of the operators who manually hang the items of laundry on the transporting clips of the conveying device at the loading stations. The items of laundry are called up from the storage means in a specific manner as soon as the spreading device is free to receive the next item of laundry.

BRIEF DESCRIPTION OF THE DRAWINGS

Preferred exemplary embodiments of the invention are explained in greater detail below with reference to the drawing, in which.

DETAILED DESCRIPTION OF PREFERRED EMBODIMENTS

Figure 1:
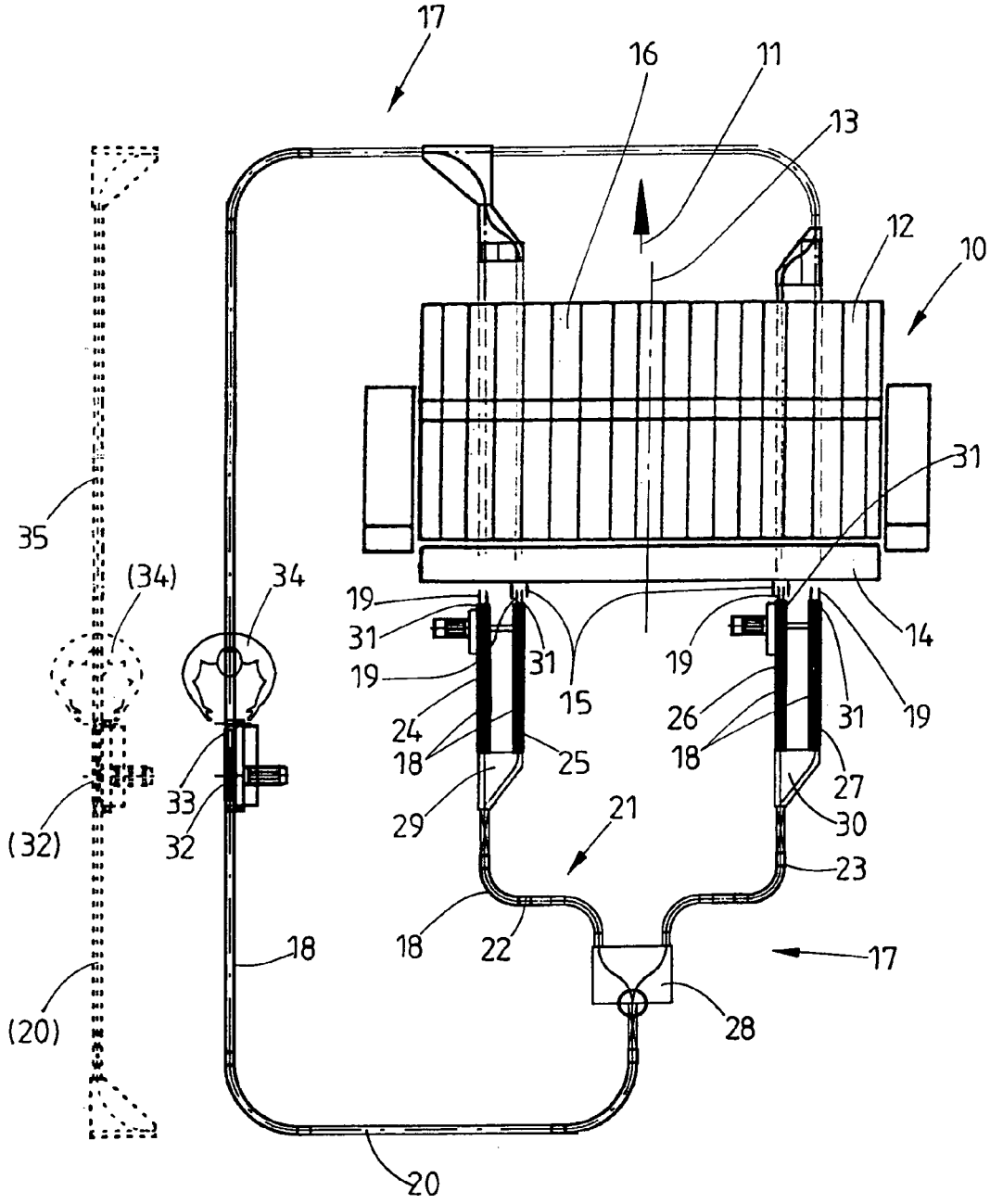
FIG. 1 shows a schematic plan view of an apparatus according to a first exemplary embodiment of the invention.

The apparatus shown here has an insertion machine 10 which is arranged upstream of a mangle (not shown in the figure) or another laundry treatment device in relation to the insertion direction 1. The apparatus also has a conveying device 17 with which individual items of laundry (not shown) can be transported to the insertion machine 10.

The insertion machine 10 has a feed conveyor 12 with which spread-out items of laundry can be transported to the mangle and inserted into the mangle. The insertion machine 10 can be operated either with a single track or with a multiple track. The insertion machine 10 can also be designed in such a way that it permits mixed single- or twin-track operation. In the case of single-track operation, in each case one item of laundry is transported to the mangle or another laundry treatment device centrally relative to the longitudinal center axis 13, which runs in the insertion direction 1, of the feed conveyor 12. The single-track mode of operation of the insertion machine 10 is particularly suitable for relatively large items of laundry whose width, that is to say the length of the stretched-out front edge which leads in the insertion direction 1, is greater than half the width of the feed conveyor 12. In the case of the twin-track mode of operation of the insertion machine 10, smaller items of laundry with a width which is less than half the width of the feed conveyor 12 are fed to the mangle or another laundry treatment device independently of one another on each track-half, which is located on opposite sides of the longitudinal center axis 13, of the feed conveyor 12.

A spreading device 14 is arranged upstream of the feed conveyor 12 as seen in the insertion direction 1. In the exemplary embodiment shown, the spreading device 14 has a pair of spreading clips comprising two spreading clips 15 which can be moved on a common rail or two separate rails which preferably runs/run transverse to the insertion direction 11 over the entire width of the feed conveyor 12. It is also feasible for the spreading device 14 to have more than two spreading clips 15, for example two pairs of spreading clips. One item of laundry is in each case spread out by the spreading clips 15 upstream of the feed conveyor 12 by the front edge of the item of laundry which is held by the spreading clips 15 at opposite corners being stretched. In addition, the respective item of laundry is centred centrally in relation to the respective track, specifically centrally to the longitudinal center axis 13 in the case of single-track insertion and centrally to the respective track-half in the case of twin-track insertion, by the spreading clips 15. The spreading clips 15 place the spread-out item of laundry directly or indirectly (when there is an interposed insertion strip) onto the conveying belt 16, which is driven so as to revolve in the insertion direction 11, of the feed conveyor 12 with the stretched front edge leading.

The conveying device 17 transports the items of laundry to the spreading device 14 of the insertion machine 10 by degrees. The conveying device 17 shown here has transporting clips 19 which can move on rails 18. The transporting clips 19 run along downwardly sloping portions of the rails 18 automatically, that is to say without a drive in the conveying device 17.

The conveying device 17 shown is of continuous design, in order to continually move the transporting clips 19 in a revolving manner in one or more rail circuits. To this end, a conveying section portion 20 through which the transporting clips 19 can be transported one behind the other is provided. In addition to the single-track conveying section portion 20, the conveying device 17 has a multiple-track conveying section portion 21 which follows the said single-track conveying section portion in the insertion direction 11. In the first instance, the multiple-track conveying section portion 21 has two conveying sections 22, 23. In the exemplary embodiment shown, each of these conveying sections 22, 23 is adjoined, in turn, by two conveying sections 24, 25 on one side of the conveying section portion 21 and two conveying sections 26, 27 on the other side of the conveying section portion 21. The single-track conveying section portion 20 of the conveying device 17 shown is therefore multiply branched since first two conveying sections 22, 23 and then four parallel conveying sections 24, 25, 26 and 27 adjoin the said conveying section portion in the insertion direction 11. Switch points 28, 29 and 30 serve to branch the conveying sections. The four parallel conveying sections 24, 25, 26 and 27 end upstream of the spreading device 14, to be precise such that an item of laundry can be passed to the spreading clips 15 of the spreading device 14 from the transporting clips 19 of the respective conveying section 24, 25, 26 or 27 or the spreading clips 15 can receive an item of laundry from the transporting clips 19.

The multiple-track conveying section portion 21 is branched symmetrically to the longitudinal center axis 13 of the insertion machine 10. To this end, the conveying sections 22 and 23 are situated on opposite sides of the longitudinal center axis 13. Equally, the conveying sections 24 and 25 on one side and 26 and 27 on the other side are distributed on different sides of the longitudinal center axis 13 of the insertion machine. In this case, all the conveying sections 24, 25, 26 and 27 run parallel to one another and parallel to the insertion direction 11. In other words, the conveying sections 24, 25, 26 and 27 run in the insertion direction 11. The conveying sections 24, 25, 26 and 27 are arranged symmetrically to the longitudinal center axis 13 of the feed conveyor 12 in such a way that two conveying sections 24, 25 and 26, 27 are located on either side of the longitudinal center axis 13, with the distances of the inner conveying sections 25 and 26 in relation to the longitudinal center axis 13 being equal. In addition, the distances of the outer conveying sections 24 and 27 in relation to the longitudinal center axis 13 are equal. Consequently, the two conveying sections 24 and 25 on one side and 26 and 27 on the other side, which are arranged on either side of the longitudinal center axis 13, are also at identical distances from one another. However, these distances between the conveying sections 24 and 25 and the conveying sections 26 and 27 are smaller than the distance between the inner conveying sections 25 and 26 on opposite sides of the longitudinal center axis 13, whereas the distance between the inner conveying sections 25 and 26 is in turn smaller than the distance between the outer conveying sections 24 and 27.

Figure 2:
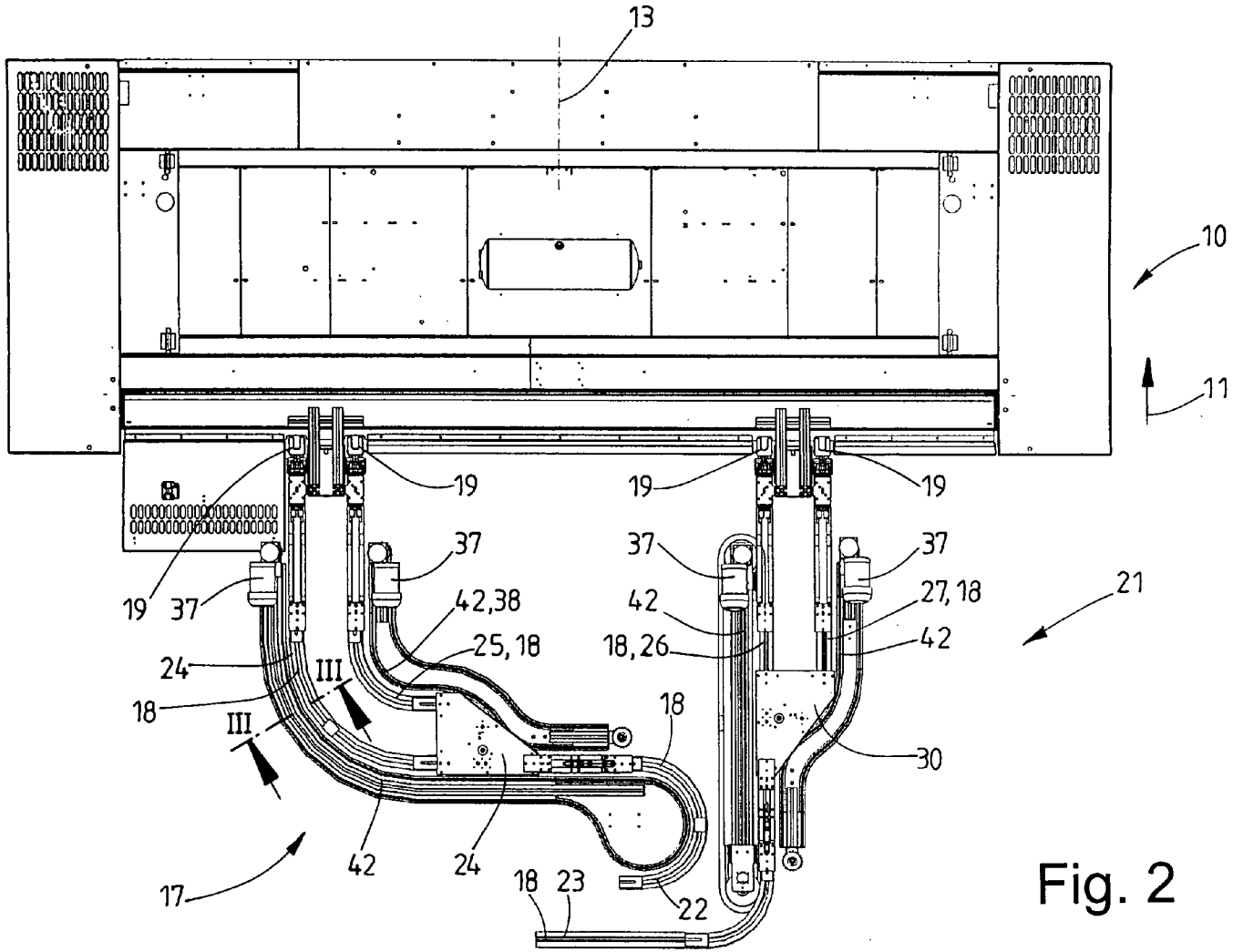
FIG. 2 shows an enlarged plan view of the apparatus according to an alternative exemplary embodiment in the region in which the upper edge of the item of laundry is preliminarily spread out before the item of laundry is transferred to the spreading clips of the insertion machine.

In the exemplary embodiment of FIG. 2, the transporting clips 19 are driven along the rails 18 in the region of at least some of the conveying sections 24, 25, 26 and 27 and the switch points 28, 29 and 30. The transporting clips 19 are also preferably driven in end regions of the conveying sections 22 and 23 upstream of the switch points 29 and 30. If necessary, the transporting clips 19 can be driven in other regions of the rails 18, in particular where the regions of these rails do not run in a downward direction but in a horizontal direction or even in an upwardly sloping manner.

The transporting clips 19 are driven upstream of, in and downstream of the switch points 29 and 30 by separate conveying lines 36 which are driven so as to revolve and which are in the form of continuous brush belts in the exemplary embodiment shown. Each conveying section 24, 25, 26 and 27 upstream of the insertion machine 10 has a dedicated revolving conveying line 36 with a drive 37. The drive 37 may be an electromotive drive, possibly with a gear mechanism.

Figure 3:
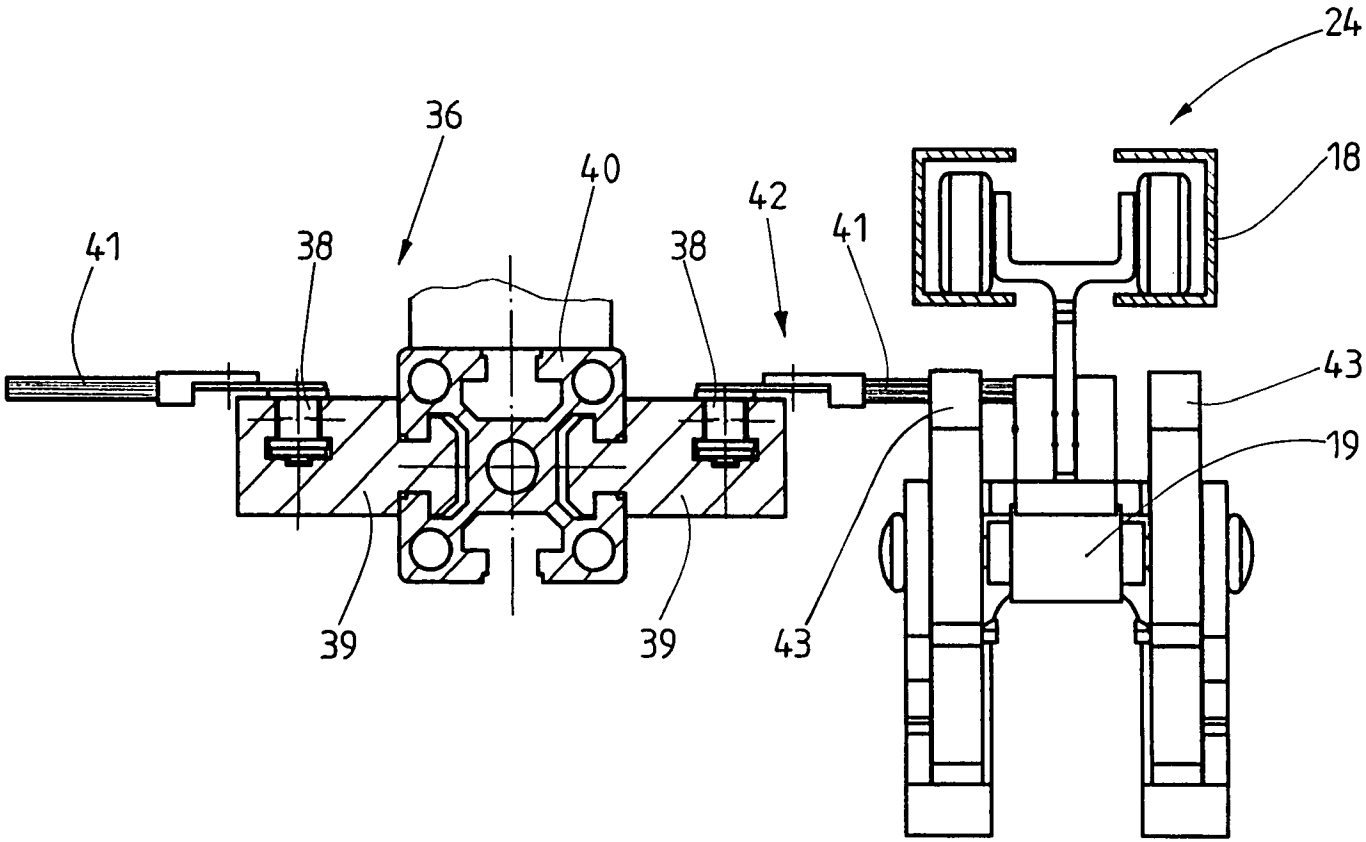
FIG. 3 shows an enlarged illustration of section III-III from FIG. 2 through a rail which forms a conveying section and the drive train, which is arranged next to it, for a transporting clip which can be moved along the rail.

As shown in FIG. 3 in particular, each revolving conveying line 36 has a continuous chain 38 which slides along in guides 39 which are fixed to a common support section 40. Laterally protruding, horizontal bundles 41 of bristles or else individual bristles are arranged on the upper face of the chain 38, to be precise preferably on each chain element of the said chain. The chain 38, with the large number of bundles 41 of bristles fixed to it, forms the so-called brush belt. The bundles 41 of bristles protrude laterally outwards from the outer face of the guides 39 which is directed away from the support section 40. The conveying lines 36 are arranged on a side next to and somewhat below the rail 18 in order to form the respective conveying section 24, 25, 26 and 27 in such a way that the bundles 41 of bristles of a strand 42, which faces the rails 18, of the revolving conveying line 36 engage with the respective transporting clip 19. The bundles 41 of bristles preferably engage behind the clipping lever 43 on that side of the transporting clips 19 which faces the conveying line 36. The force exerted on the transporting clips 19 by the bundles 41 of bristles which engage with the transporting clips 19 serves to drive the transporting clips 19 along the conveying sections 24, 25, 26 and 27 when the conveying line is driven so as to revolve by the drive 37. In this case, the bundles 41 of bristles are supported behind the respective clipping lever 43 in such a way that the said clipping lever is acted on so as to close during further movement of the respective transporting clip 19, that is to say the clipping levers 43 are not opened by the transporting clips 19 being driven by the conveying line 36. The bundles 41 of bristles serve to uniformly drive the transporting clips 19 of all the conveying sections 24, 25, 26 and 27. Furthermore, the elastic bundles 41 of bristles or the elastic bristles lead to smooth coupling of the conveying line 36 to the respective transporting clip 19. In addition, movements of the transporting clips 19 relative to the rail 18, to be precise in the transverse direction, are possible during further transportation of the transporting clips 19 along the rail 18. The elastic bundles 41 of bristles also permit a transporting clip 19 to smoothly pass a preceding transporting clip 19, in particular a stationary transporting clip 19, since downstream bundles 41 of bristles can be moved past a stationary transporting clip 19 by virtue of corresponding deformation of the bristles. The drive train 36 with the laterally protruding elastic bundle 41 of bristles or bristles therefore practically operates in accordance with the principle of an accumulating conveyor.

All of the conveying sections 24, 25, 26 and 27 of identical design have, upstream of the feed conveyor 12, a U-shaped profile comprising two parallel upright, preferably vertical, conveying sections 31 which are connected at the lower end by means of a semicircular bow. The vertical conveying line 31, which faces the spreading device 14, of each conveying section 24, 25, 26 and 27 is arranged so closely upstream of the spreading device 14 that the transporting clips 19 which are transported upwards on the respective vertical conveying line 31 which faces the spreading device 14 pass the corners of the respective item of laundry to the spreading clips 15 as they pass by the spreading clips 15 which are positioned upstream of the transporting clips 19 or the corners of the item of laundry can be received from the transporting clips 19 by the spreading clips 15.

The empty transporting clips 19 are transported away beyond the insertion machine 10 downstream of the insertion machine 10 as seen in the insertion direction 11, and there channeled into the single-track conveying section portion 20 again.

The conveying device 17 has at least one loading station 32. In the region of the loading station 32, items of laundry are hung by way of adjacent corners of an upper edge in successive transporting clips 19 one by one by an operator. The loading station 32 is associated with the single-track conveying section portion 20. The loading station 32 is preferably located in a location, which is remote from the insertion machine 10, in the first conveying section portion 20. In this way, the portion of the conveying device 17 which is located between the loading station 32 and the end of the single-track conveying section 20 can serve as a storage means for a plurality of items of laundry which are hung on transporting clips 19. However, it is also feasible to store a plurality of items of laundry which are hung on transporting clips 19 in the region of the downstream conveying section portion 21 upstream of the spreading device 14, in particular in the region of the conveying sections 22 and 23.

The loading station 32 preferably has an oblique or vertical conveying line 33 which is dimensioned such that the operator 34 can hang the corners of the respective item of laundry in the following transporting clips 19 of the conveying device 17 in an ergonomically expedient manner. On account of the vertical or oblique upward slope of the conveying line 33, the item of laundry is raised by the conveying device 17 after the adjacent corners of the said item of laundry are hung in successive transporting clips 19, so that the items of laundry hang freely downwards from the transporting clips 19, without touching the floor, during further transportation.

Apart from the vertical conveying lines 31 and 33, the rails 18 are arranged beneath a production hall ceiling in order to form the remaining parts of the conveying section portions 20 and 21.

The conveying device 17 can be provided with a plurality of loading stations 32. For example, a second loading station 32—as indicated by dashed lines in the figure—can be arranged next to the first loading station 32 for this purpose. The second additional loading station 32 has an associated parallel conveying line 35 which is connected to the conveying section portion 20 by means of switch points or the like.

The invention is not restricted to the conveying device 17 having the various profiles shown in FIG. 1 and FIG. 2. Rather, any desired profiles of the conveying device 17 are suitable for implementing the invention.

The conveying device 17, preferably each loading station 32, can have an associated measuring device for measuring the width of the respective item of laundry. The measuring device is preferably designed such that it determines the width of the item of laundry without having to spread the front edge of the item of laundry to be measured for this purpose. The length of the front edge of the item of laundry, that is to say the extent to which the spreading clips 15 of the spreading device 14 have to spread the front edge of the item of laundry before placing it onto the feed conveyor 12, is preferably automatically measured. The measurement can be performed mechanically, for example as described in European Patent 0 548 797 B1, or else electronically by means of light sensors. As an alternative, the width of the front edge of the item of laundry can also be entered into a control system of the apparatus. It is also feasible for the width of the item of laundry to be read off from a data storage medium, for example a chip, which is associated with the said item of laundry. The extent to which the item of laundry has to or can be preliminarily spread out by the conveying device 17 upstream of the spreading device 14 is defined as a function of the width of the respective item of laundry. Accordingly, the transporting clips 19 which hold adjacent corners of the item of laundry are channeled into the corresponding different conveying sections 24, 25, 26 or 27.

The method according to the invention is explained below with reference to the described apparatus:

An operator 34 in each case hangs an item of laundry on the respective loading station 32 by way of two adjacent corners of an edge, preferably a front edge, in successive transporting clips 19 of the conveying section portion 20 of the conveying device 17. In this case, the transporting clips 19 are located at such a height relative to the respective operator 34 that the said operator can insert the corners of the respective item of laundry into the transporting clips 19 without becoming fatigued, specifically while seated if desired. The item of laundry which is hung on two successive transporting clips 19 is then raised along the perpendicularly directed conveying line 33 in the region of the loading station 32 to the level of the single-track conveying section portion 20 of the conveying device 17 at which it no longer touches the floor.

In the region of the respective loading station 32 or another location of the following conveying section portion 20, the length of the edge of the item of laundry which is held between the transporting clips 19 in the slack state is mechanically or electrically determined and provided for controlling the further method sequence. As an alternative, the width of the item of laundry or the length of the front edge of the said item of laundry can be read out of a data storage medium of the item of laundry. The conveying section portion 20 between the respective loading station 32 and the following conveying section portion 21 or else the conveying sections 22 and 23 of the conveying section portion 21 can receive a relatively large number of items of laundry, which are hung on transporting clips 19, and therefore temporarily store a plurality of items of laundry.

At the end of the conveying section portion 20, the respectively frontmost item of laundry, together with the two transporting clips 19 which hold the said item of laundry, is discharged along the conveying section portion 21 for further transportation, with the item of laundry being reoriented by the front edge of the item of laundry now being oriented transverse to the insertion direction 11, for which reason the two transporting clips 19 which hold the item of laundry move along different conveying sections 24, 25, 26 or 27. Depending on the size of the previously measured or known width of the item of laundry, the transporting clips 19 which hold the said item of laundry are conducted to the conveying sections 24 and 25 via the conveying section 22, to the conveying sections 26 and 27 via the conveying section 23 or to the conveying sections 24 and 27 or 25 and 26 via the conveying sections 22 and 23 by means of corresponding positioning of the switch points 28, 29 or 30. In order for the transporting clips 19 to reliably pass through at least the switch points 29 and 30, they are driven by the conveying lines 36, which are in the form of brush belts with laterally protruding bundles 41 of bristles, primarily into the regions of the switch points 29 and 30.

Large items of laundry with a long front edge, which require single-track insertion, are transported to the outer conveying sections 24 and 27 upstream of the spreading device 14 via the conveying sections 22 and 23 by virtue of corresponding positioning of the switch points 28, 29 and 30. The item of laundry is virtually completely spread out, in particular preliminarily spread out or preliminarily spread, upstream of the spreading device 14 by the two transporting clips 19 which hold the item of laundry at opposite corners being channeled into the outer conveying sections 24 and 27. The front edge of the item of laundry is for the most part stretched during this preliminary spreading out. However, the front edge is not completely stretched after preliminary spreading out. On the conveying sections 24 and 27, the transporting clips 19 are at a distance at which the front edge is stretched by more than 50% and up to 90%, that is to say the distance between the transporting clips 19 corresponds to about 50% to 90% of the width of the item of laundry. Smaller items of laundry which also require single-track insertion because they have a width which is greater than half the width of the feed conveyor 12 are conducted to the inner parallel conveying sections 25 and 26 via the conveying sections 22 and 23 at a smaller distance than to the outer conveying sections 24 and 27. As a result, smaller items of laundry are also preliminarily spread out, but not completely stretched. Relatively small items of laundry can therefore also be preliminarily stretched out at between 50% and 90% of their width by the conveying device 17 upstream of the spreading device 14. Even smaller items of laundry which permit twin-track insertion, that is to say have a width which is smaller than half the width of the feed conveyor 12, are conducted to the conveying sections 24 and 25 or 26 and 27 either via the conveying section 22 or 23 by way of transporting clips 19 which still run one behind the other on the said conveying section. In this case, the respective item of laundry is also reoriented transverse to the insertion direction 11 during transfer of the item of laundry from the conveying section 22 or 23 to the conveying sections 24 and 25 or 26 and 27.

The conveying sections 24 and 25 on one side and 26 and 27 on the other side, which are provided on different sides of the spreading device 14, are at relatively short distances from one another. Accordingly, relatively small items of laundry are not preliminarily spread out at all or are only very slightly preliminarily spread out before they are passed to the spreading clips 15 of the spreading device 14 for multi-track insertion.

The respective item of laundry is transferred from the transporting clips 19, which hold this item of laundry at opposite corners, to the spreading clips 15 of the spreading device 14 on the upright, in particular vertical, conveying line 31, which faces the spreading device 14, of the respective conveying section 24, 25, 26 or 27. These upright conveying lines 31 are arranged so closely upstream of the spreading device 14 that the corners of the item of laundry are transferred to the spreading device 14 as the transporting clips 19 which are further driven during transfer pass by the spreading clips 15. This results in flying or continuous transfer of the respective corner of the item of laundry from a transporting clip 19 to the spreading clip 15, which is moved upstream of this transporting clip, of the spreading device 14 or results in the corner being received from the transporting clip 19 by the respective spreading clip 15. FIG. 1 schematically shows the transfer of an item of laundry from the transporting clips 19 of the inner conveying sections 25 and 26 on opposite sides of the longitudinal center axis 13 of the feed conveyor 12. After the control system has threaded the transporting clips 19, with the item of laundry, into the inner conveying sections 25 and 26, it emits to the spreading device 14 a signal to move the spreading clips 15 in front of the upright conveying lines 31 of the inner conveying sections 25 and 26. In this case, the spreading clips 15 are already moved away from one another to such an extent that they receive the item of laundry which is preliminarily spread out by the conveying device 17 in the preliminarily spread-out state by way of an only slightly sagging front edge. After the item of laundry is received by the spreading device 14, the spreading clips 15 have to be moved away from one another only slightly in order to stretch the front edge of the item of laundry so far that it is substantially completely stretched and can be directly or indirectly passed to the feed conveyor 12 with a front edge which hardly sags at all.

In the case of relatively wide items of laundry which are preliminarily spread out by the outer conveying sections 24 and 27, the spreading clips 15 are moved in front of the vertical conveying lines 31 of the outer conveying sections 24 and 27 in order to receive the preliminarily spread-out item of laundry from these conveying sections. A large item of laundry then also only needs to be finally spread out by the spreading clips 15 in order to substantially completely stretch the front edge.

In the case of relatively small items of laundry which permit twin-track insertion, the spreading clips 15 are moved in front of the vertical conveying lines 31 of the conveying sections 24 and 25 or 26 and 27 depending on whether the respective item of laundry is to be placed on the left-hand track or right-hand track of the feed conveyor 12. In this case, where the front edge of the item of laundry is hardly preliminarily spread out on account of the conveying sections 24 and 25 or 26 and 27 being situated close together, the item of laundry is virtually entirely spread out and the front edge of the said item of laundry is stretched by means of the spreading clips 15 of the spreading device 14. Since relatively small items of laundry require only a short movement path of the spreading clips 15, this does not have any significant effect on the insertion rate of the insertion machine 10.

On account of the width of the item of laundry which is preferably known as a result of measurement before preliminary spreading out, the said item of laundry can be channeled from the conveying section portion 20 into conveying sections 25, 26 or 24, 27, which are at a corresponding distance from one another, in the course of the downstream conveying section portion 21, as a result of which the items of laundry are correspondingly preliminarily spread out. Large items of laundry are preliminarily spread out in the same way as smaller items of laundry, which are channeled into the conveying sections 25 and 26, which are closer together, in order to be preliminarily spread out, by being channeled into the outer conveying sections 24 and 27 in accordance with their large width. The spreading clips 15 then need to be moved only a short distance away from one another in order to stretch the front edge of the item of laundry completely, with the spreading clips 15 being moved away from one another to such an extent that the distance between them corresponds approximately to the width of the item of laundry which is known as a result of previous measurement.

The transporting clips 19, which are empty after the item of laundry is passed to the spreading device 14, are moved beyond the insertion machine 10 along the conveying sections 24, 25, 26 and 27 downstream of the insertion machine 10 and there channeled into the start of the single-track conveying section portion 20 again, as a result of which the transporting clips 19 are conducted in a closed circuit within the conveying device 17. When there are a plurality of loading stations 32 next to one another, the empty transporting clips 19 are distributed to the conveying lines 33 of the conveying section portion 20 which are situated variously parallel next to one another, so that an adequate supply of empty transporting clips 19 is always available at all the loading stations 32.

LIST OF REFERENCE SYMBOLS

10. Insertion machine
11. Insertion direction
12. Feed conveyor
13. Longitudinal center axis
14. Spreading device
15. Spreading clip
16. Conveying belt
17. Conveying device
18. Rail
19. Transporting clip
20. Conveying section portion
21. Conveying section portion
22. Conveying section
23. Conveying section
24. Conveying section
25. Conveying section
26. Conveying section
27. Conveying section
28. Switch points
29. Switch points
30. Switch points
31. Vertical conveying line
32. Loading station
33. Conveying line
34. Operator
35. Parallel conveying line
36. Drive train
37. Drive
38. Chain
39. Guide
40. Support section
41. Bundle of bristles
42. Strand
43. Clipping lever

What is claimed is:

1. A method for feeding items of laundry to a laundry treatment device, such as a mangle, the method including measuring the items of laundry, the method comprising:

measuring the width of the items of laundry;

preliminarily spreading out at least some of the items of laundry by a conveying device (17) as a function of the width of the items of laundry between adjacent corners of a front edge of the items of laundry;

transferring the respective item of laundry from the conveying device (17) to spreading clips (15) of a spreading device (14);

spreading out the item of laundry by the spreading device (14); and transporting the spread-out item of laundry from a feed conveyor (12) to the laundry treatment device, wherein the items of laundry are spread out in a suspended manner with two adjacent corners of the items of laundry on transporting clips (19) by deliberate introduction of the transporting clips (19) which hold the corners of the item of laundry into selected conveying sections (24, 25, 26 or 27) at a distance which is somewhat smaller than the spread-out front edge of the item of laundry and wherein the corners of the front edge of the item of laundry are channeled into conveying sections (24, 25, 26, 27).

2. The method according to claim 1, wherein relatively large items of laundry are spread out over a larger distance between the corners which bound the front edge than smaller items of laundry.

3. The method according to claim 1, further comprising measuring the length of the front edge of the respective item of laundry before the respective item of laundry is preliminarily spread out by the conveying device (17).

4. The method according to claim 1, wherein the adjacent corners of the front edge of the item of laundry are channeled into the conveying sections (24, 25, 26, 27) of the conveying device (17), the conveying sections (24, 25, 26, 27) being parallel to each other, before the corners are passed to the spreading device (14).

5. The method according to claim 4, wherein the conveying sections (24, 25, 26, 27) of the conveying device (17) upstream of the spreading device (14) are at such distances from one another that the items of laundry are spread out as a function of the previously measured width of the respective item of laundry when the corners of the front edge of the respective item of laundry are channeled into parallel conveying sections (24, 25, 26, 27).

6. The method according to claim 1, wherein the transporting clips (19) which hold the respective item of laundry are driven, when they are moved, in order to spread out the item of laundry.

7. The method according to claim 4, wherein the corners of the front edge of the item of laundry are channeled into the conveying sections (24, 25, 26, 27) at different distances as a function of the length of the front edge.

8. A method for feeding items of laundry to a laundry treatment device, such as a mangle, the method including measuring the items of laundry, the method comprising:

measuring the width of the items of laundry;

preliminarily spreading out at least some of the items of laundry by a conveying device (17) as a function of the width of the items of laundry between adjacent corners of a front edge of the items of laundry;

transferring the respective item of laundry from the conveying device (17) to spreading clips (15) of a spreading device (14);

spreading out the item of laundry by the spreading device (14); and transporting the spread-out item of laundry from a feed conveyor (12) to the laundry treatment device, wherein the corners of the front edge of the item of laundry are channeled into conveying sections (24, 25, 26, 27) which permit single-track insertion or which permit twin-track insertion, as a function of the length of the front edge of the item of laundry, and wherein the items of laundry are spread out in a suspended manner with two adjacent corners of the items of laundry being held on transporting clips (19) by deliberate introduction of the transporting clips (19) holding the corners of the item of laundry into the conveying sections (24, 25, 26 or 27) at a distance which is somewhat smaller than the spread-out front edge of the item of laundry.

9. An apparatus for feeding items of laundry to a laundry treatment device, such as a mangle, having:

a feed conveyor (12);

a spreading device (14), which is arranged upstream of the said feed conveyor, for spreading out the item of laundry by stretching a front edge of the said item of laundry, with the spreading device (14) having at least two spreading clips (15) for holding opposite corners of the front edge of the item of laundry;

a conveying device (17), which has movable transporting clips (19), for transporting the item of laundry, which is held at the corners which bound the front edge, to the spreading clips (15) of the spreading device (14), wherein the conveying device (17):

i) comprises at least one associated loading station (32);

ii) comprises at least two parallel conveying sections (24, 25, 26, 27) upstream of the spreading device (14), which conveying sections are at such a distance from one another that the transporting clips (19) which are located in different conveying lines (24, 25, 26, 27) hold the opposite corners of the item of laundry by way of a preliminarily spread-out front edge;

iii) comprises a single-track insertion conveying section (24, 25, 26, 27) and a twin-track insertion conveying section (24, 25, 26, 27); and iv) is of single-track design at least proximal to each loading station (32) whereby the two transporting clips (19) that hold opposite corners of the front edge of the item of laundry are transported one behind the other through the common conveying section portion (20); and means for channeling the corners of the front edge of the item of laundry into different ones of the at least two parallel conveying sections (24, 25, 26, 27) of the conveying device (17) before the corners are passed to the spreading device (14), wherein the means for channeling channels the corners of the front edge of the item of laundry into the conveying section (24, 25, 26, 27) as a function of the length of the front edge of the item of laundry.

10. The apparatus according to claim 9, wherein the conveying device (17) has more than two parallel conveying sections (24, 25, 26, 27), which are arranged symmetrically to the center of the spreading device (14), upstream of the spreading device (14).

11. The apparatus according to claim 9, wherein in each case at least two conveying sections (24, 25, 26, 27) are arranged on opposite sides of the center of the spreading device (14), with the distance between the conveying sections (24, 25, 26, 27) on each side of the center of the spreading device (14) being smaller than between adjacent conveying sections (24, 25, 26, 27) on different sides of the spreading device (14).

12. The apparatus according to claim 9, wherein the conveying sections (24, 25, 26, 27) arranged upstream of the spreading device (14) have rising conveying lines (31) which are associated with the spreading clips (15) of the spreading device (14) in such a way that the corners of the item of laundry held on the transporting clips (19) can be passed from the transporting clips (19), which are moved along the rising conveying lines (31), to the spreading clips (15).

13. The apparatus according to claim 9, wherein the conveying device (17) has at least one rising conveying line (33) proximal to each loading station (32).

14. The apparatus according to claim 9, wherein the conveying section portion (20) which jointly accommodates the transporting clips (19) for holding the corners of the respective item of laundry leads via switch points (28, 29, 30) directly or via intermediate conveying sections to the plurality of parallel conveying sections (24, 25, 26, 27) upstream of the spreading device (14).

15. The apparatus according to claim 14, wherein the switch points (28, 29, 30) are designed to distribute the two transporting clips (19) which hold the corners of the respective item of laundry to different parallel conveying sections (22, 23; 24, 25, 26, 27).

16. The apparatus according to claim 14, wherein the switch points (28, 29, 30) are designed to distribute the two transporting clips (19) which hold the corners of the respective item of laundry to different parallel conveying sections (22, 23; 24, 25, 26, 27), the distribution being performed as a function of the width of the item of laundry.

17. The apparatus according to claim 9, wherein the conveying device (17) has at least one storage means for a plurality of items of laundry.

18. The apparatus according to claim 9, wherein the conveying device (17) has drives with which the transporting clips (19) can be individually driven in selected regions of the conveying device (17).

19. The apparatus according to claim 18, wherein the respective drive has a drive train (36) which can be driven so as to revolve and by which the transporting clips (19) located in its region can be individually moved further along selected regions of the rail (18) of the conveying section portion (21).

20. The apparatus according to claim 19, wherein each drive train (36) has a plurality of laterally protruding elastic drivers which can make contact with the respective transporting clips (19).

21. The apparatus according to claim 19, wherein each drive train (36) is in the form of a brush belt.

22. The apparatus according to claim 10, wherein in each case at least two conveying sections (24, 25, 26, 27) are arranged on opposite sides of the center of the spreading device (14), with the distance between the conveying sections (24, 25, 26, 27) on each side of the center of the spreading device (14) being smaller than between adjacent conveying sections (24, 25, 26, 27) on different sides of the spreading device (14).

23. A method for feeding items of laundry to a laundry treatment device, such as a mangle, comprising:

transferring the respective item of laundry from a conveying device (17) to spreading clips (15) of a spreading device (14);

spreading out the item of laundry by the spreading device (14); and transporting the spread-out item of laundry from a feed conveyor (12) to the laundry treatment device, wherein at least some of the items of laundry are spread out at least for the most part by the conveying device (17) and the spread-out items of laundry are passed to the spreading clips (15), wherein corners of a front edge of the item of laundry are channeled into different, parallel conveying sections (24, 25, 26, 27) of the conveying device (17) before the corners are passed to the spreading device (14), and wherein the conveying sections (24, 25, 26, 27) of the conveying device (17) upstream of the spreading device (14) are at such distances from one another that the items of laundry are spread out as a function of the previously measured width of the respective item of laundry when the corners of the front edge of the respective item of laundry are channeled into parallel conveying sections (24, 25, 26, 27).

24. An apparatus for feeding items of laundry to a laundry treatment device, such as a mangle, the apparatus comprising:

a feed conveyor (12); and a spreading device (14), which is arranged upstream of the said feed conveyor, for spreading out the item of laundry by stretching the front edge of the said item of laundry, with the spreading device (14) having at least two spreading clips (15) for holding opposite corners of the front edge of the item of laundry, and having a conveying device (17), which has movable transporting clips (19), for transporting the item of laundry, which is held at the corners which bound the front edge, to the spreading clips (15) of the spreading device (14), wherein the conveying device (17) has at least two parallel conveying sections (24, 25, 26, 27) upstream of the spreading device (14), which conveying sections are at such a distance from one another that the transporting clips (19) which are located in different conveying lines (24, 25, 26, 27) hold the opposite corners of the item of laundry by way of a preliminarily spread-out front edge, wherein a conveying section portion (20) which jointly accommodates the transporting clips (19) for holding the corners of the respective item of laundry leads via switch points (28, 29, 30) directly or via intermediate conveying sections to the plurality of parallel conveying sections (24, 25, 26, 27) upstream of the spreading device (14), wherein the switch points (28, 29, 30) are designed to distribute the two transporting clips (19) which hold the corners of the respective item of laundry to different parallel conveying sections (22, 23; 24, 25, 26, 27), the said distribution being performed as a function of the width of the item of laundry, wherein the conveying device (17) comprises a single-track insertion conveying section (24, 25, 26, 27) and a twin-track insertion conveying section (24, 25, 26, 27), and wherein the conveying device (17) is of single-track design at least proximal to each loading station (32) whereby the two transporting clips (19) that hold opposite corners of the front edge of the item of laundry are transported one behind the other through the common conveying section portion (20).

25. The apparatus according to claim 24, wherein the means for channeling channels the corners of the front edge of the item of laundry into the single-track insertion conveying section (24, 25, 26, 27) or into the twin-track insertion conveying section (24, 25, 26, 27) as a function of the length of the front edge of the item of laundry.

26. The apparatus according to claim 23, wherein the means for channeling channels the corners of the front edge of the item of laundry into a single-track insertion conveying section (24, 25, 26, 27) or into a twin-track insertion conveying section (24, 25, 26, 27) as a function of the length of the front edge of the item of laundry.

* * * * *